US007452193B1

(12) United States Patent
Wright

(10) Patent No.: US 7,452,193 B1
(45) Date of Patent: Nov. 18, 2008

(54) ADJUSTABLE PUMP ASSEMBLY WITH SINGLE MOTOR AND MULTIPLE PUMPS

(75) Inventor: Nigel Patrick Wright, Marion, IA (US)

(73) Assignee: Vector Corporation, Marion, IA (US)

( * ) Notice: Subject to any disclaimer, the term of this patent is extended or adjusted under 35 U.S.C. 154(b) by 663 days.

(21) Appl. No.: 10/767,557

(22) Filed: Jan. 29, 2004

(51) Int. Cl.
*F04B 23/04* (2006.01)
*F04B 41/06* (2006.01)

(52) U.S. Cl. ..... 417/429; 417/359; 417/360

(58) Field of Classification Search ..... 417/321, 417/359, 429, 360; 83/571, 574, 549, 564
See application file for complete search history.

(56) References Cited

U.S. PATENT DOCUMENTS 3,055,551 A * 9/1962 Johnson ..... 222/63
3,298,238 A 1/1967 Lea
3,816,033 A * 6/1974 Fried et al. ..... 417/429
4,187,057 A 2/1980 Xanthopoulos
4,265,155 A * 5/1981 Lopez et al. ..... 83/479
4,522,570 A 6/1985 Schartz
4,653,987 A 3/1987 Tsuji et al.
5,181,842 A 1/1993 Sunderland et al.
6,454,543 B1 * 9/2002 Beck et al. ..... 417/199.1

FOREIGN PATENT DOCUMENTS

EP 0 570 546 B1 11/1993

* cited by examiner

*Primary Examiner*—Devon Kramer
*Assistant Examiner*—Patrick Hamo
(74) *Attorney, Agent, or Firm*—McKee, Voorhees & Sease, P.L.C.

(57) ABSTRACT

A pump assembly includes a base plate upon which a drive motor is mounted and pump plate upon which first and second pumps are mounted. The pump plate is adjustably mounted on the base plate so as to be moveable between first and second positions relative to the base plate. In the first position, the first pump is operatively engaged with the motor and the second pump is disengaged from the motor. In the second position, the second pump is operatively engaged with the motor and the first pump is disengaged from the motor. An operator can quickly and easily change from one pump to the other simply by loosening thumbnuts, repositioning the pump plate on the base plate, and tightening the nuts.

20 Claims, 2 Drawing Sheets

ADJUSTABLE PUMP ASSEMBLY WITH SINGLE MOTOR AND MULTIPLE PUMPS

BACKGROUND OF THE INVENTION

Pumps are used in many industries to convey fluid from one location to another. For example, in the coating industry, spray nozzles connected to pumps apply various solutions to products. Generally, if more than one type of solution is to be applied to a product, separate pumps are normally provided, each with its own separate drive motor, controls, and cabinet or cart. This prior art system with dual components is expensive and utilizes valuable floor space in the coating room.

Therefore, a primary objective of the present invention is a provision of an improved pump assembly using a single motor with multiple pumps.

Another objective of the present invention is the provision of an improved pump assembly for a coating room which mounts on a wall so as to increase usable floor space.

A further objective of the present invention is the provision of a method for changing a pump assembly from a first pump to a second pump, both utilizing a single motor.

Yet another objective of the present invention is the provision of a pump assembly which is economical to manufacture and durable and efficient in use.

These and other objectives will become apparent from the following description of the invention.

BRIEF SUMMARY OF THE INVENTION

A pump assembly is provided with a motor mounted on a base plate, and a drive gear extending from the motor. A pump plate is adjustably connected to the base plate and is moveable between first and second positions relative to the base plate. A first pump is mounted on the pump plate and has a gear in mesh with the motor gear when the pump plate is in the first position. A second pump is mounted on the pump plate and has a gear in mesh with the motor gear when the pump is in the second position. The first and second pumps are disengaged from the motor gear when the pump plate is in the second and first positions, respectively. The base plate may be mounted on a wall or on a portable cabinet or cart.

In the method of the present invention, the pump assembly is quickly and easily changed from the first pump to the second pump by moving the pump plate to the desired first or second position so as to engage the proper pump with the motor drive gear. The pump plate can be fixed in position on the base plate by one or more knobs which can be quickly and easily tightened by hand.

DETAILED DESCRIPTION OF THE PREFERRED EMBODIMENT

Figure 1:
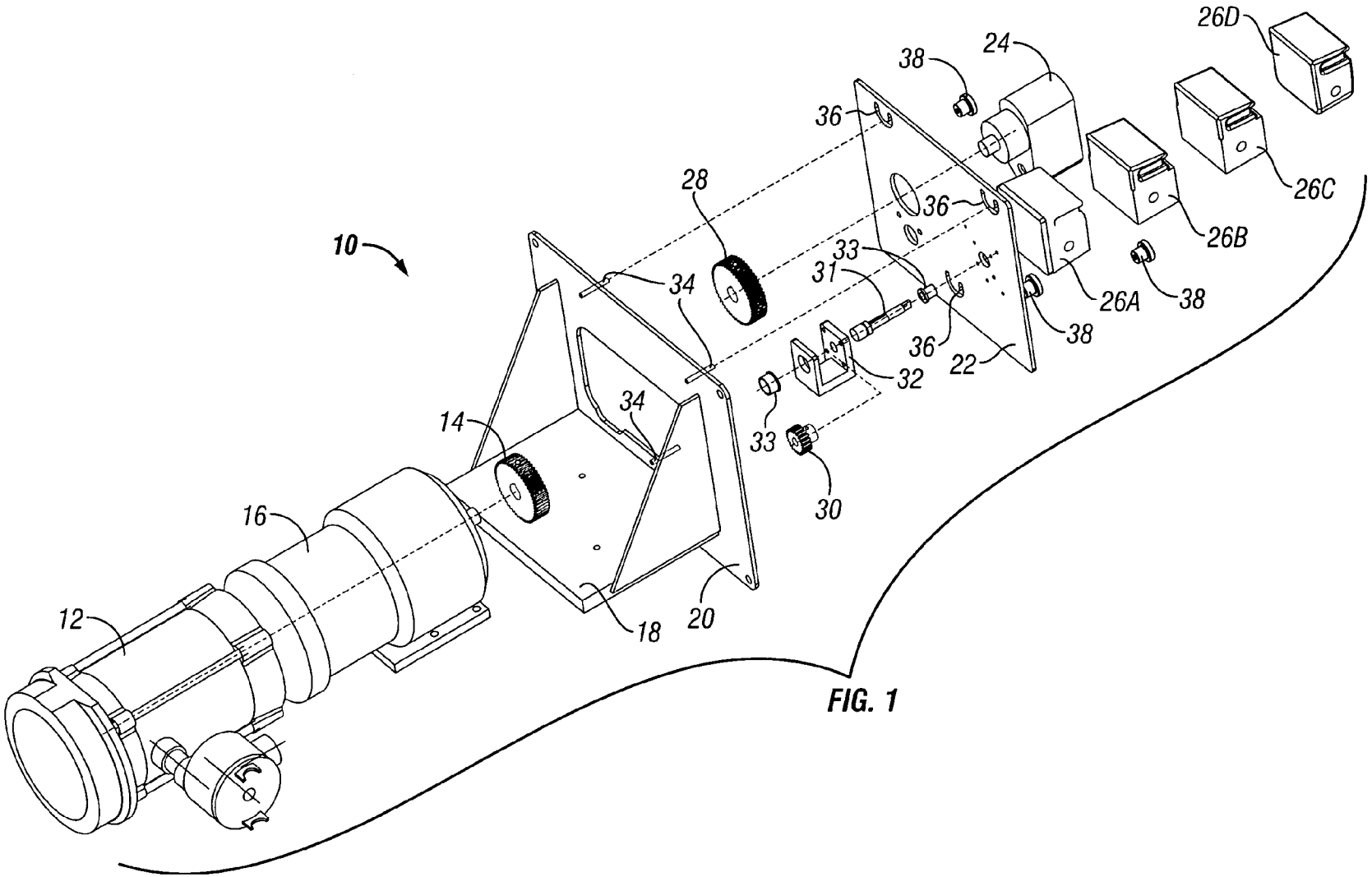
FIG. 1 is an exploded perspective view of the pump assembly of the present invention, showing examples of different pumps which can be utilized.

The pump assembly 10 of the present invention includes a drive motor 12 having an output shaft with a drive gear 14 thereon. An optional reducer 16 may be provided for the motor 12. The motor 12 and reducer 16 are mounted on a support shelf 18 which is part of a base plate 20.

The pump assembly 10 also includes a plurality of pumps mounted upon a pump plate 22. For example, a gear pump 24 and a series of peristaltic pumps 26A, B, C, D are mounted to the pump plate 22 in a convenient fashion. The gear pump 24 includes a gear 28 on the opposite side of the pump plate 22, and the peristaltic pumps 26A-D include a gear 30 mounted in a bracket or yoke 32 via a shaft 31 and bushings 33 on the opposite side of the pump plate 22.

The base plate 20 includes a plurality of threaded studs 34 which are adapted to extend through slots 36 on the pump plate 22. Thumbnuts 38 tighten on the studs 34 so as to lock the pump plate 22 in position on the base plate 20. The pump plate 22 may be secured to the base plate 20 in any other convenient manner that allows for quick and easy adjustment of the plate 22. For example, over-center cam levers or other fasteners may be used.

Figure 2:
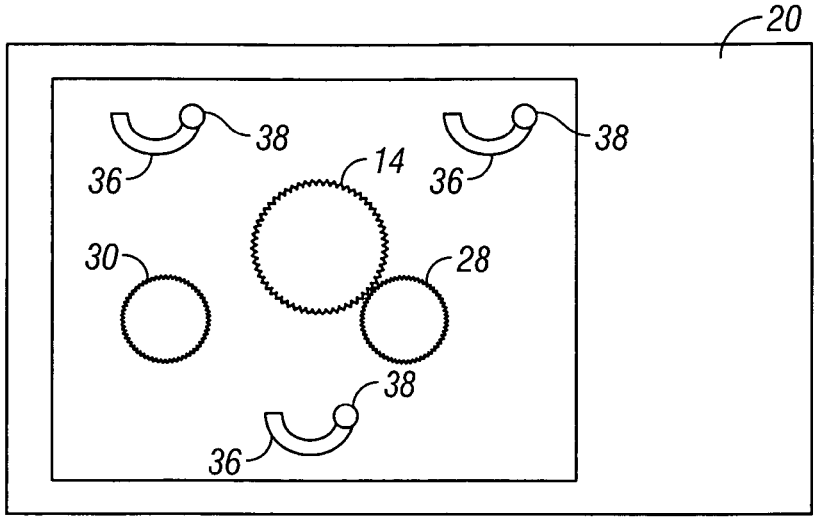
FIGS. 2 and 3 are schematic views showing the pump plate in first and second positions, respectively, relative to the base plate.
Figure 3:
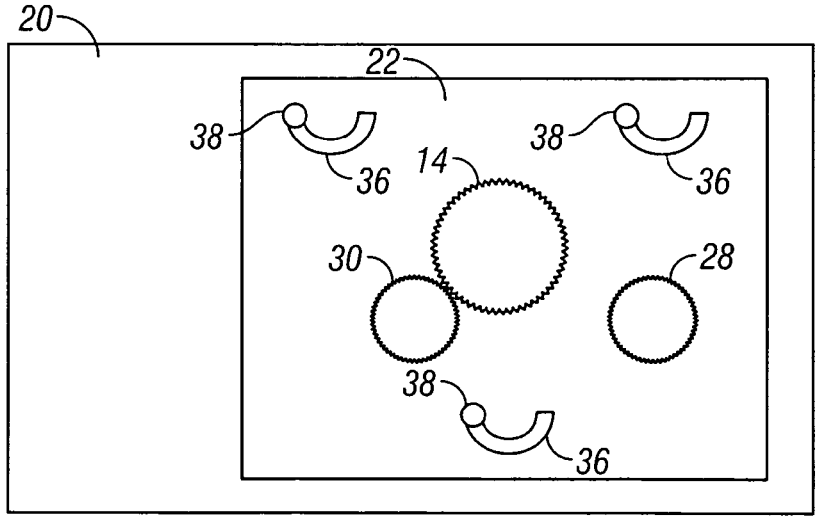
Figure 4:
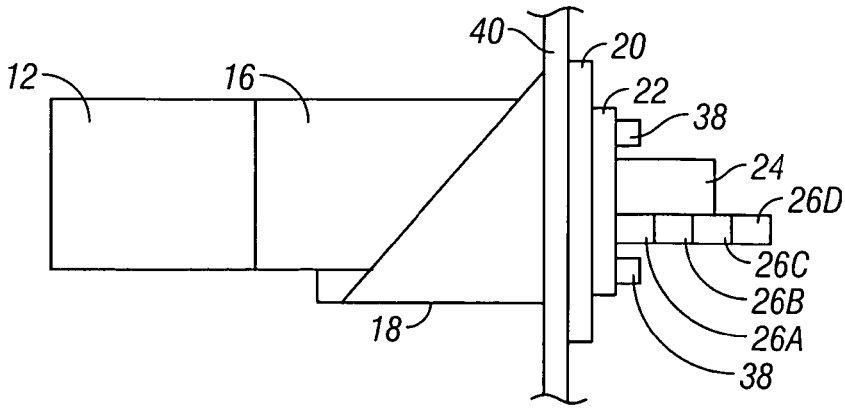
FIG. 4 is a side elevation view showing the assembled pump assembly mounted on a wall or cart.

When the thumbnuts 38 are loosened, the pump plate 22 may be moved or adjusted between first and second positions relative to the base plate 20. In the first position, shown in FIG. 2, the gear 28 of the pump 24 is in mesh with the motor gear 14, and the gear 30 of the pumps 26A-D is disengaged from the motor gear 14. In the second position of the pump plate 22, shown in FIG. 3, the gear 28 of the pump 24 is disengaged from the motor gear 14 and the gear 30 of the pumps 26A-D is in mesh with the motor gear 14. Thus, in the first position of the pump plate 22, the gear pump 24 is driven by the motor 12, and the pumps 26A-D are inoperative. In the second position of the pump plate 22, the peristaltic pumps 26A-D are operative and the gear pump 24 is inoperative. Changing between the pump 24 and the pumps 26A-D is achieved quickly and easily simply by loosening the thumbnuts 38, moving the pump plate 22 to the desired position, and tightening the thumbnuts 38.

The pump assembly 10 may be mounted on a wall 40 or on a portable cart. For example, on a wall mount application for a spray coating room, the base plate 20 is mounted on the wall 40, with the shelf 18 extending through the wall 40 such that the motor 12 is behind the wall. The pump plate 22 with pumps 24 and 26A-D are mounted to the base plate 20 so as to be in the coating room. An operator can select the desired pump 24 or 26A-D and adjust the position of the pump plate 22 relative to the base plate 20 so that the single motor 12 will drive the selected pump. The pumps 24 and 26A-D are operatively connected to sources of fluids to pumped, such that, for example, a first solution can be sprayed onto a product via pump 24 and then a second solution can be sprayed on the product via pumps 26A-D, merely by loosening the nuts 38, shifting the position of the pump plate 22 and tightening the nuts 38.

It is understood that any types of pumps may be mounted on the pump plate 22 and any mix of pumps may be utilized, such as two peristaltic pumps of different capacities or two different sized gear pumps. Also, the speed of each pump may be controlled by an external electrical frequency control unit (not shown). The pump plate 22 can be removed from the base plate 20 so that the pumps can be removed for cleaning, or other pumps installed, while the motor 12 and reducer 16 remain fixed to either the wall or the portable cabinet.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A pump assembly, comprising:

a base plate;

a motor mounted on the base plate and having a single drive gear thereon;

a pump plate connected to the base plate and being movable while attached to the base plate between first and second positions relative to the base plate;

a first pump mounted on the pump plate and having a gear in mesh with the drive gear when the pump plate is in the first position; a second pump mounted on the pump plate and having a gear in mesh with the drive gear when the pump plate is in the second position; and the single drive gear alternatingly engaging the gears of the first and second pumps when the pump plate is in the first and second positions, respectively.

2. The pump assembly of claim 1 wherein the gear of the first pump is disengaged from the drive gear when the pump plate is in the second position and the gear of the second pump is disengaged from the drive gear when the pump plate is in the first position.

3. The pump assembly of claim 1 wherein the base plate is mountable to a building wall so that the motor is on one side of the building wall and the pumps are on the other side of the building wall.

4. The pump assembly of claim 1 wherein a plurality of threaded studs on the base plate extend through slots on the pump plate to thereby detachably mount the pump plate to the base plate.

5. The pump assembly of claim 1 wherein the pump plate includes at least one slot extending through the pump plate to provide the first and second positions and the base plate includes a pin extending through the slot whereby the pump plate slides between the first and second positions.

6. The pump assembly of claim 1 wherein a hand actuated knob is threaded onto threaded studs on the base plate to thereby adjustably secure the pump plate in the first and second positions.

7. A method of changing a pump assembly from a first pump to a second pump, comprising:

mounting the first and second pumps to a common pump plate for simultaneous support by the plate;

mounting the pump plate to a base plate;

sliding the pump plate laterally in a first direction while attached to the base plate to a first position relative to the base plate whereby the first pump is engaged with a drive gear on the base plate; and sliding the pump plate laterally in a second direction opposite the first direction while attached to the base plate to a second position relative to the base plate whereby the second pump is engaged with the drive gear on the base plate.

8. The method of claim 7 wherein the first pump is disengaged from the drive motor when the pump plate is in the second position and the second pump is disengaged from the drive motor when the pump plate is in the first position.

9. The method of claim 7 further comprising mounting the base plate to a building or cabinet wall with the drive motor and pumps being on opposite sides of the building or cabinet wall.

10. The method of claim 7 wherein the pump plate is detachably mounted to threaded studs on the base plate.

11. The method of claim 7 further comprising securing a hand knob to threaded studs on the base plate to thereby keep the pump plate in the first and second positions.

12. A pump assembly, comprising:

a motor with a drive gear;

first and second pumps having gears at a common end;

a pump plate for simultaneously supporting both the pumps, and being slidably positioned for movement in opposite first and second lateral directions; and whereby sliding movement of the pump plate moves the pumps so that the gear of one of the pumps is meshed with the drive gear and the gear of the other one of the pumps is disengaged from the drive gear in each position.

13. The pump assembly of claim 12 wherein the pumps are mounted on a pump plate which is movable to thereby move the pumps between first and second positions while mounted to the base plate.

14. The pump assembly of claim 13 wherein the motor is mounted on a base plate having a plurality of threaded studs and the pump plate is adjustably mounted and moveable with respect to the plurality of threaded studs.

15. The pump assembly of claim 14 further comprising at least one hand-actuated knob to secure to the plurality of threaded studs to thereby selectively lock the pumps in first and second positions.

16. A pump assembly, comprising:

a base plate for mounting a motor thereon and passing a drive gear of the motor there through;

a pump plate connected to the base plate by one or more slots to direct sliding movement of the pump plate relative to the base plate between a first position and a second position;

a first pump mounted on the pump plate and having a gear in mesh with the drive gear when the pump plate is moved to the first position; and a second pump mounted on the pump plate and having a gear in mesh with the drive gear when the pump plate is moved to the second position the base plate and pump plate being parallel to one another; and the motor drive gear and first and second pump gears all having parallel axes of rotation.

17. The pump assembly of claim 16 wherein the pump plate is moveable between the first position and the second position while connected to the base plate.

18. The pump assembly of claim 16 wherein the base plate further comprises one or more threaded studs for extending through the slots on the pump plate.

19. The pump assembly of claim 1 wherein the motor gear and pump gears have parallel axes of rotation.

20. The pump assembly of claim 16 wherein the base plate and pump plate having mating inner surfaces and opposite, parallel outer surfaces from which the motor and pumps extend in opposite directions.

* * * * *